US005154302A

United States Patent [19]

Alcorn

[11] Patent Number: 5,154,302

[45] Date of Patent: Oct. 13, 1992

[54] SIDE WALL CONSTRUCTION FOR OPEN TOP CONTAINERS

[76] Inventor: John W. Alcorn, P.O. Box 50610, Jacksonville Beach, Fla. 32240

[21] Appl. No.: 724,830

[22] Filed: Jul. 2, 1991

[51] Int. Cl.[5] ..... B65D 88/52

[52] U.S. Cl. ..... 220/4.16; 220/1.5; 220/682

[58] Field of Search ..... 52/588, 223 R, 222, 52/169.7; 405/278, 281; 220/684, 682, 1.5, 4.01, 4.03, 4.16, 4.26, 672, 670, 669, 692, 8; 105/396, 411, 404

[56] References Cited

U.S. PATENT DOCUMENTS

| | | | |
|---|---|---|---|
| 1,066,822 | 7/1913 | Lamp | 405/281 |
| 1,755,725 | 4/1930 | Clark et al. | 220/4.26 |
| 1,933,838 | 11/1933 | Ashe | 220/672 |
| 2,235,865 | 3/1941 | Burgess | 220/670 |
| 2,885,070 | 5/1959 | Ondrejka | 224/4.26 |
| 3,596,420 | 8/1971 | Ducker | 52/222 |
| 4,046,277 | 9/1977 | Morrison | 220/1.5 |
| 4,795,049 | 1/1989 | Alcorn | 220/1.5 |
| 4,805,794 | 2/1989 | Tsuchiya | 220/1.5 |
| 4,809,474 | 3/1989 | Ekberg, Jr. | 52/233 R |
| 4,930,427 | 6/1990 | Ritter et al. | 105/411 |
| 5,058,756 | 10/1991 | Green | 220/692 |

FOREIGN PATENT DOCUMENTS

| | | | |
|---|---|---|---|
| 0282807 | 9/1990 | Fed. Rep. of Germany | 105/396 |
| 249573 | 3/1926 | United Kingdom | 405/281 |
| 273661 | 1/1928 | United Kingdom | 405/278 |

*Primary Examiner*—Stephen Marcus
*Assistant Examiner*—S. Castellano

[57] ABSTRACT

An open top container having at least one side wall constructed of vertically disposed panels having horizontally extending corrugations or ribs lending beam and column strength to the side wall panels. The panels of that side wall can have an interconnecting slip joint permitting limited horizontal movement between the panels. One or more of the side posts of at least that side wall can have inner and outer sleeved sections permitting vertical movement of the bottom end relative to the top end while restricting horizontal movement and forces. The side post vertical movement permits the transference of portions of the vertical, load imposed forces from the top rail to the corrugated ribs of the side wall panels. The composite beam consisting of the top rail, bottom rail, corrugated panels and side post can be prestressed for additional advantages. Also, both walls of a rectangular container for maximum advantage should include the horizontal corrugations and the sleeved side post.

10 Claims, 4 Drawing Sheets

SIDE WALL CONSTRUCTION FOR OPEN TOP CONTAINERS

BACKGROUND OF THE INVENTION

1. Field of the Invention.

This Invention relates to the side wall and side post construction of open top containers for moving, transporting and storing materials.

2. Summary of the Prior Art

Open top containers for moving or storing materials generally have a bottom, side walls and end walls. The container is basically open at the top but may have a removable cover or have a non-rigid closed top. Examples of such containers are truck trailers, rail cars or scrap gondolas and are illustrated in U.S. Pat. No. Des. 238,259 and U.S. Pat. No. 4,252,067.

The conventional configuration for the side wall of these containers is a bottom rail attached to a horizontal rectangular floor and to vertical side posts and flat sheet material to which is attached a top rail. The cover sheets of material are rigidly fastened to the bottom rail, vertical studs and top rail to form the container. The top and bottom rails are designed to carry the vertical load of the material in the container similar to the top and bottom flanges of a conventional I-Beam and the flat cover sheets serve as, both, the web of a conventional I-Beam and the enclosing wall to contain the load. The side posts of prior art are designed and rigidly placed to support the flat cover sheets in containing the load and to resist the outward horizontal forces while, also, transmitting any forces on the bottom rail directly to the top rail.

In both open top and closed top containers, the bottom rail is in tension and the top rail is in compression. In open top containers, however, the top rail is in non-laterally supported compression and must, therefore, be designed as a column to carry the load within the container. As loads are increased, the compressive force is increased tending to buckle or bow the top rail outwardly requiring an increase in size and/or lateral support with cross ties to prevent buckling failure. Such cross ties are undesirable for freely loading and unloading the container and are subject to damage or removal by the container user. Thus, conventional open top container designs have relied on the top rail to carry the downward forces of the load as a beam and on cross ties or increased size to offset the compressive buckling of the top rail.

SUMMARY OF THE INVENTION

It is an object of this invention to provide an improved side wall construction for use in open top containers, the side wall being formed of full-length multiple panels having horizontal corrugations or ribs to carry the downward and buckling forces imposed on the container by the load of the material within the container. The corrugations or ribs improve the moment of inertia of the side wall to resist the outward forces of the load on the side wall and to accept portions of the compressive buckling forces on the top rail.

It is, also, an object of this invention to provide an interconnecting slip joint between vertically adjacent corrugated panels which permits longitudinal movement between the panels to allow each individual panel to react as a separate beam when desired.

It is a further object of this invention to provide a side post which permits or allows forces on the floor or bottom rail of the container to be distribute to the side wall panels thus relieving portions of the forces which would, otherwise be placed directly on the top rail.

It is, also, an object of this invention to provide a side wall which may be prestressed to further reduce the compressive buckling forces on the top rail.

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

BRIEF DESCRIPTION OF THE DRAWINGS

FIG. 2*a* is an enlarged sectional view of the slip joint attachment to the bottom rail.

FIG. 2*b* is an enlarged sectional view of the slip joint attachment between two panels.

FIG. 2*c* is an enlarged sectional view of the slip joint attachment to the top rail.

DESCRIPTION OF THE PREFERRED EMBODIMENTS

Figure 1:
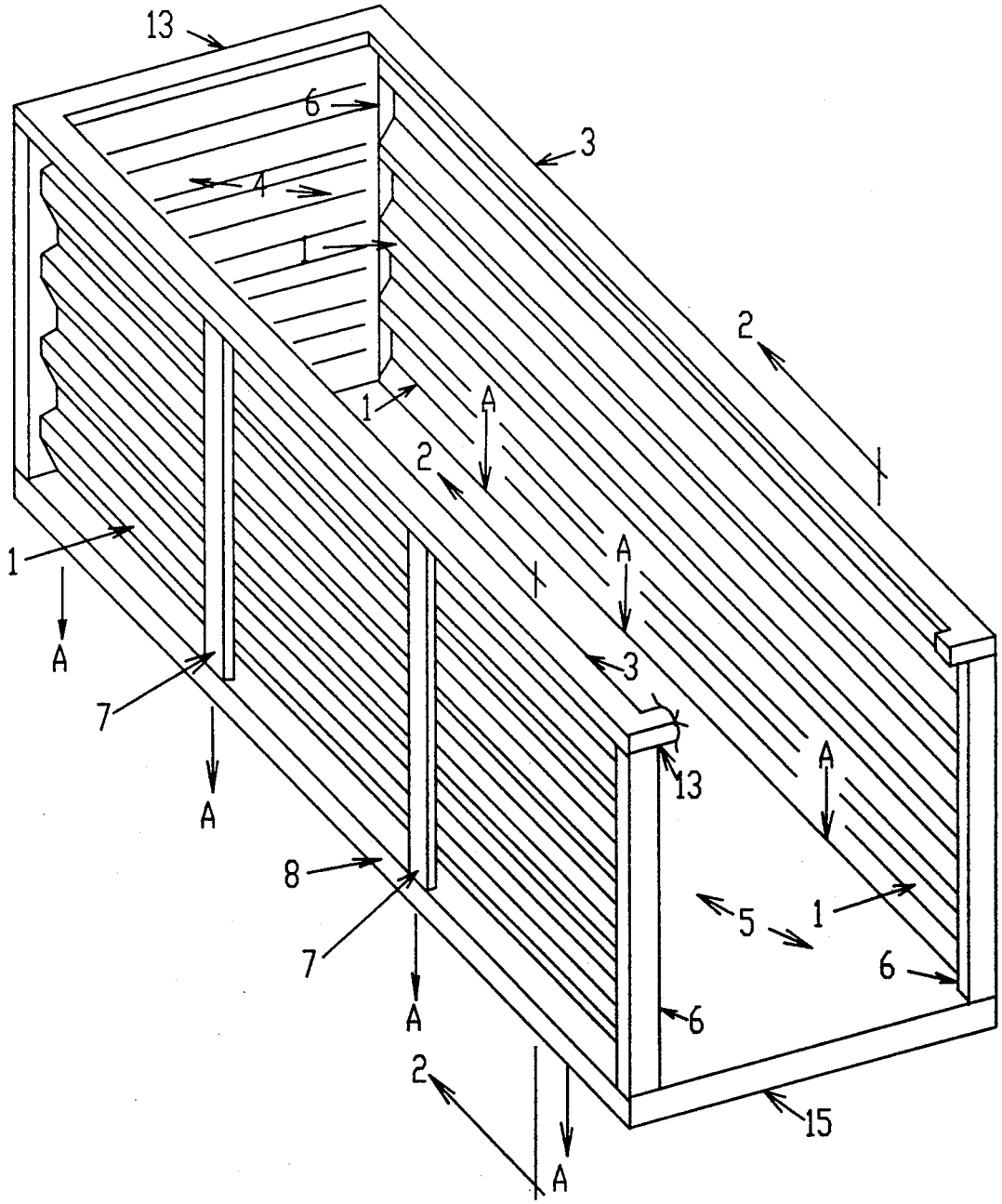
FIG. 1 is an illustration of an open top container in which the improved generally corrugated side wall construction in accord with this invention can be utilized.

Attention is now directed to FIG. 1 which illustrates an open top container in which the invention herein can be readily utilized. It should be noted, however, that this invention can be adapted to other types of containers such as truck trailers, rail cars, roll-off gondolas, those containers used for containerized freight and closed top containers.

These containers typically have a bottom or floor 5, side walls extending between top rail 3 and a bottom rail 8, an end wall 4, corner posts 6 and an end which is capable of opening opposite the closed end 4, respectfully.

Figure 2:
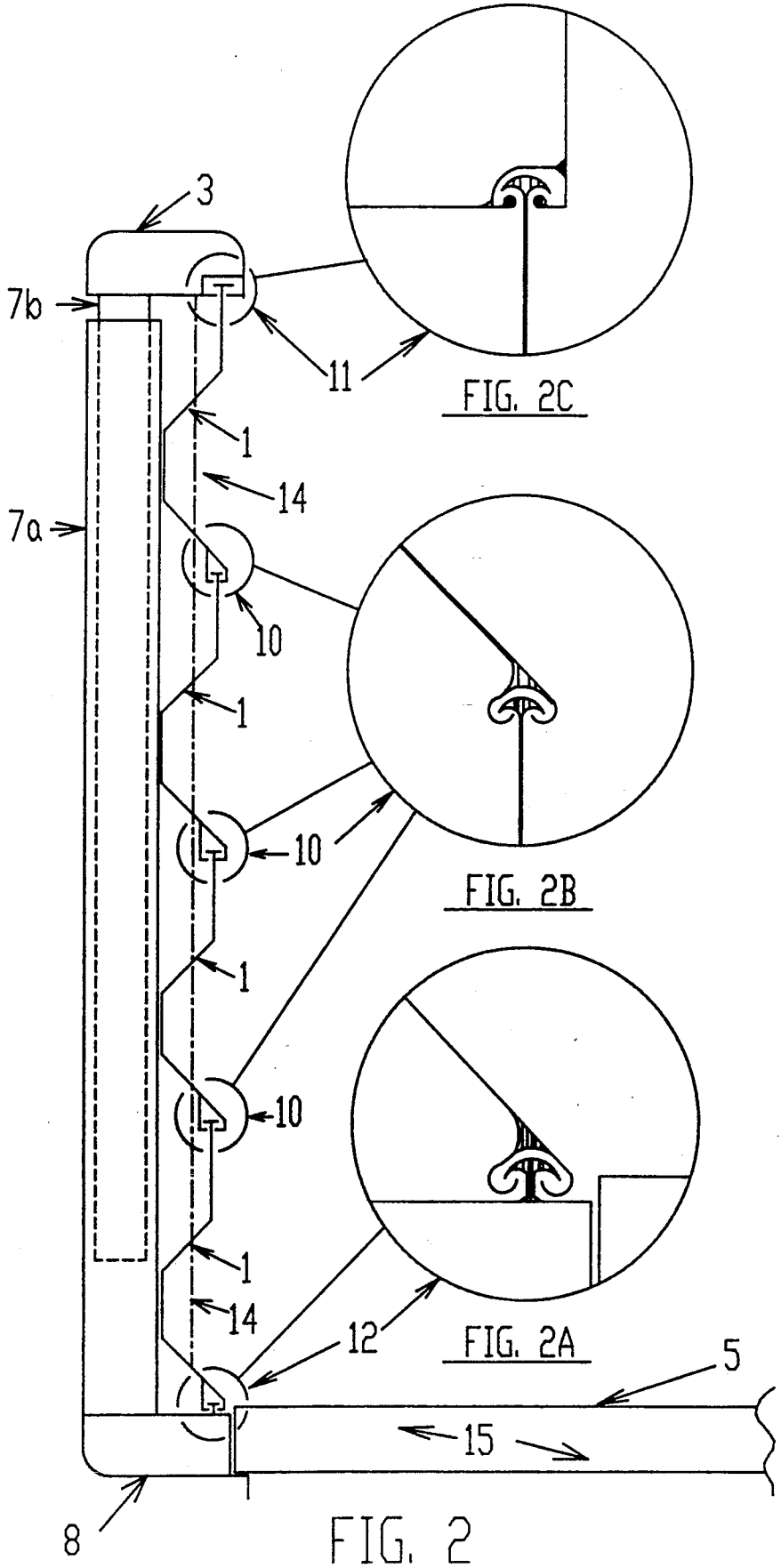
FIG. 2 is a sectional view of one side wall.

The unique corrugated vertical panel 1 and telescoping side posts 7 are illustrated in FIG. 1, and in larger detail as side post outer sleeve 7*a* and side post inner sleeve 7*b* in FIG. 2. FIG. 2 is a cross sectional view of one side wall taken along plane 2 of FIG. 1 illustrating the generally corrugated vertical panels 1, top rail 3, container floor 5, inner sleeve 7*b* and outer sleeve 7*a* of the telescoping side post 7, bottom rail 8, radius of gyration 14 of panels 1, floor support 15, and slip joint attachment configurations 10, 11, and 12 respectfully between vertical panels 1, between uppermost vertical panel 1 and top rail 3 and between lowermost panel 1 and bottom rail 8. Also included are enlarged details of the slip joint attachments 10, 11 and 12.

Also illustrated in FIG. 1 are the end top rail 13 and the floor supports 15 typical both to containers assembled per this invention and those of prior art. The arrows A indicate the downward force exerted on the bottom rails 8 by a load within the container on the floor 5. As the forces A are exerted on the bottom rail 8, the force is transferred to the vertical panels 1 instead of directly to the top rail 8 due to the telescoping action of the side posts 7. Thus the corrugated construction of the vertical panels 1 react as both a beam between the corner posts 6 and a spring between the bottom rail 8 and the top rail 3. Said reaction of panels 1 reduces the load on the top rail 3 by transferring portions of the forces to the corner posts 6 and absorbing portions of the shock loads exerted by forces A.

The loads causing the downward forces A, also, exert an outward force on the vertical panels 1 and the side posts 7 similar to the force of liquids on the wall of a filled rectangular tank. In containers of prior art, all of such outward or horizontal forces would be carried by the side posts transferring the outward bowing force to the top rail since the flat cover sheets would have no capacity for such forces. However, the vertical panel 1 is constructed in a manner similar to that shown in FIG. 2 and FIG. 3 where there is an improved moment of inertia about the radius of gyration indicated by center line 14, wherein the generally corrugated shape with the increased moment of inertia has an improved capacity to resist the outward horizontal forces. Since portions of the horizontal forces are absorbed by the vertical panels 1 and transferred to the corner posts 6, the number or size of the side posts may be reduced and the forces on top rail 3 are reduced.

Figure 3:
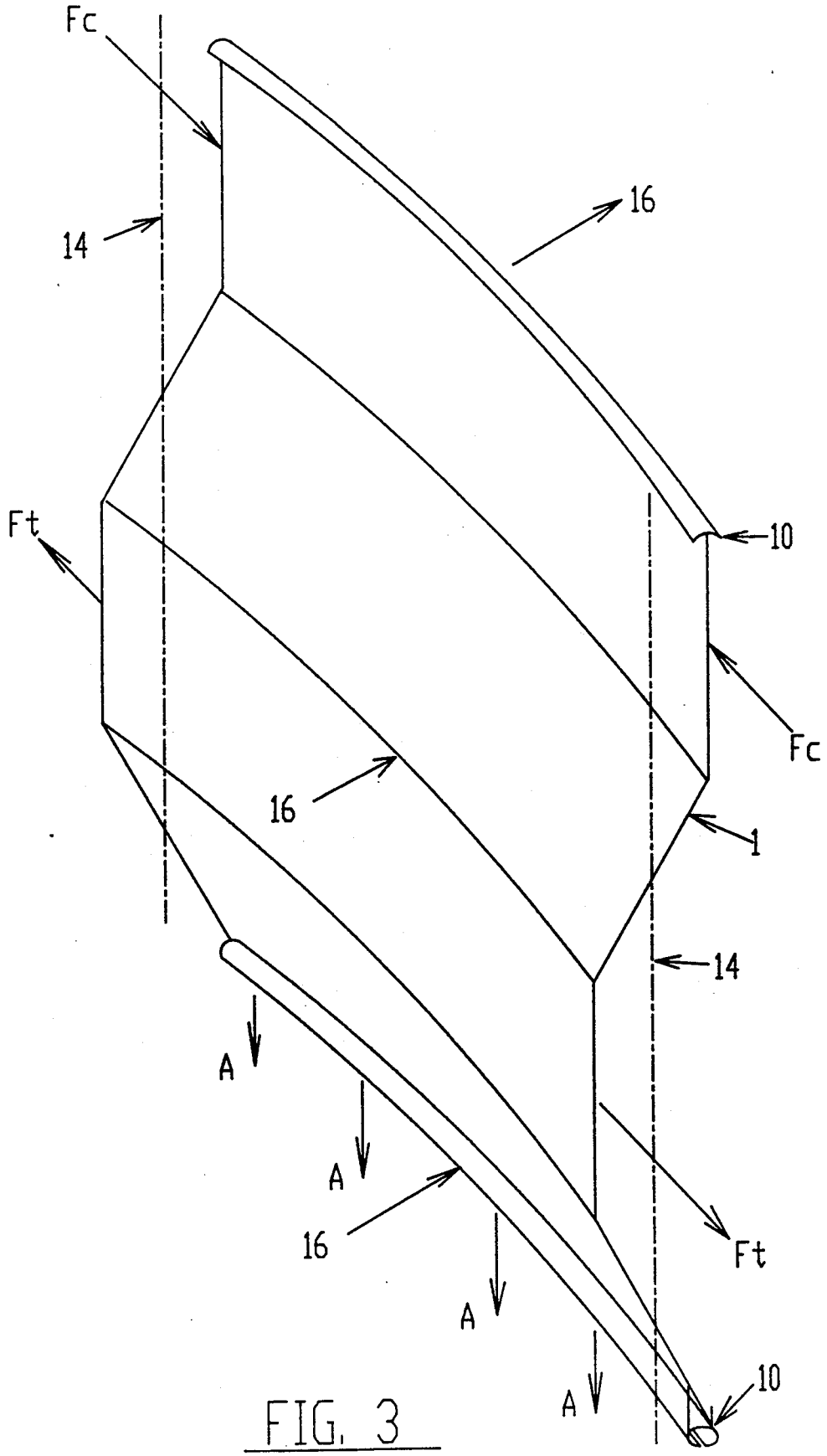
FIG. 3 is a three dimensional isometric of a portion of one corrugated side wall panel.

Another feature which reduces the outward force on the side posts 7 and the top rail 3 is illustrated in FIG. 3 wherein a section of vertical panel 1 is shown as a three dimensional isometric with radii of gyration 14, applied forces A, imposed force of compression Fc, imposed force of tension Ft and panel 1 slip joint 10 components. As vertical forces A are applied to a full length vertical panel 1, panel 1 reacts as a beam between the corner posts 6 of FIG. 1 resulting in the upper portion of panel 1 having the compression force Fc imposed while the lower portion of panel 1 has the tension force Ft imposed. The forces Fc, Ft, and A acting about the radii of gyration 14 and the developed plane thereof result in the direction of bowing deflection being controllable as indicated by arrow 16. When the direction of deflection, thus controllable, is directed toward the load within the container, the outward force on the side posts 7 and the top rail 3 is counteracted by the inward bowing force of panels 1.

Figure 4:
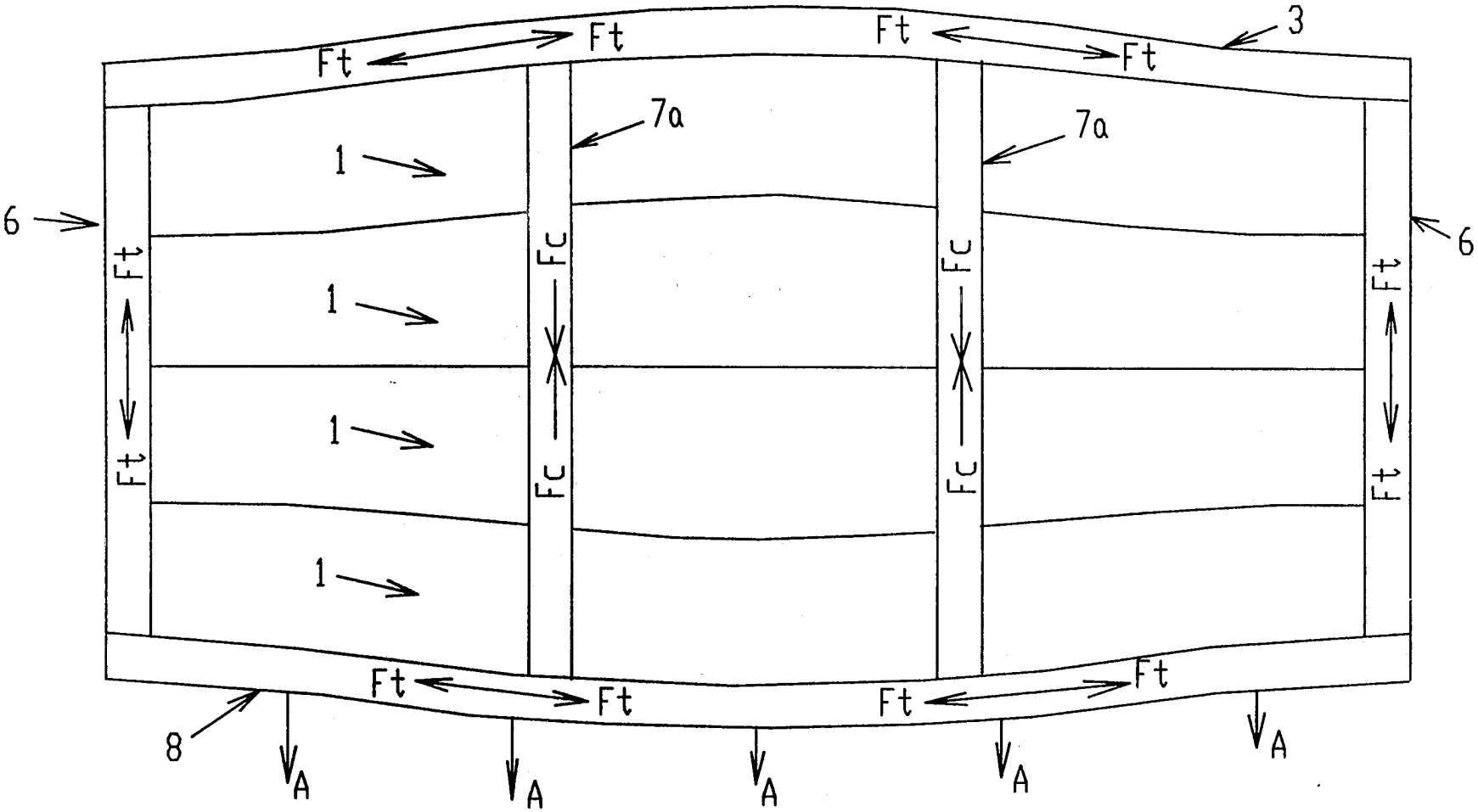
FIG. 4 is an illustration of one side wall assembled utilizing the pre-stressed feature.

Directing one's attention now to FIG. 4, the embodiment of a prestressing feature is illustrated depicting the corner posts 6, outer sleeve *7a* of side posts 7, top rail 3, bottom rail 8, vertical panels 1, force of compression Fc, force of tension Ft and vertical force A. To prestress the side wall of this invention, the outer sleeve *7a* is fabricated a calculated length longer than the corner posts 6 and installed as one of the last steps of side wall assembly after spreading the centermost section of top rail 3 and bottom rail 8 one from the other. The heretofore mentioned spring action of vertical panels 1, unique to this invention, permit this spreading action to occur. As the forces used to spread the top rail 3 and the bottom rail 8 are removed, the compression force Fc is applied to the outer sleeve *7a* of the side posts, resulting in near equal tension forces Ft in both the top rail 3 and the bottom rail 8 when the vertical forces A are near zero. As the vertical forces A are increased such as they are when the loads are placed on the floor 5, the compression force Fc on the side post outer sleeve is decreased until Fc is zero, at which time the tension and compression forces on the top rail 3 will be near zero, and the forces on the bottom rail 8 will be near the same as they would be on a container of this invention's design without prestressing or on a container of a prior art's design. As the vertical force A is further increased, the outer sleeve *7a* comes out of contact with top rail 3 and vertical panels 1 react as heretofore described in continuing the transference of portions of the forces to corner posts 6 and the top rail 3. However, the top rail 3 failure causing compression force Fc will have been reduced by predirecting the less desirable force to the corner posts 6 by prestressing the assembled side wall. When the loads are removed from the container and the forces A return to near zero, the outer sleeve *7a* contacts the top rail 3, *7a* is placed in compression and the top rail 3 and the bottom rail 8 are bowed respectfully upward and downward placing each in near equal tension forces.

While the invention has been described with respect to certain specific embodiments, it will be appreciated that many modifications and changes may be made by those skilled in the art without departing from the spirit of the invention. All structural parts can be employed on the side wall of a given container or may be separately used as described with the attendant advantages of each or may be utilized in part dependent of the advantages desired. It is intended, therefore, by the appended claims to cover all such modifications and changes as fall within the true spirit and scope of the invention.

What is claimed as new and what is desired to secure by Letters Patent of the United States is:

1. An improved side wall construction for use in an open top container wherein each side wall of said container comprises a full-length top rail, a full-length bottom rail, two corner posts and a plurality of full-length panels, each said panel having horizontally disposed means for resisting outward and downward forces which are placed on said side wall by a load within said container, said means for resisting forces being formed by generally longitudinally extending corrugated ribs to individually and independently provide beam strength for each panel, there being full-length slip joint attachments on upper and lower edges of each of said full-length panels permitting horizontal, longitudinal movement between adjacent full-length panels relative to each other after assembly, said full-length slip joint attachments formed as inter-locking configurations having a cross bar of a "T" shape fitting within an opening of a downwardly opening "C" shape permitting slip together assembly and said horizontal, longitudinal movement after assembly, allowing each of said full-length panels to react as an independent beam in resisting the forces of said load within said container, said side wall construction being operable to resist the outward forces of said load on said side wall without the use of side posts and to relieve portions of compressive buckling forces on said top rail of said container to distribute the compressive buckling forces to larger cross-sectional areas of said corrugated full-length panels.

2. The side wall construction of claim 1 further including said full-length top rail having a full-length slip joint attachment configured as a downwardly opening "C" shape for slidingly attaching an uppermost full-length panel.

3. The side wall construction of claim 1 further including said full-length bottom rail having a full-length slip joint attachment configured as a "T" shape for slidingly attaching a lowermost full-length panel.

4. The side wall construction of claim 1 wherein said corner posts are attached at ends of the attached full-length panels, ends of the top rail and ends of the bottom rail providing end support for said attached full-length panels.

5. The side wall construction of claim 1 wherein the uppermost corrugation of each panel is positioned inwardly towards the center of said container to cause inward buckling of said full-length panels providing counter-active additional beam strength to said full-length panels resisting the outward forces of the load within said container.

6. An improved side wall construction for use in an open top container wherein each side wall of said container comprises a full-length top rail, a full-length bottom rail, two corner posts, one or more spaced vertical side posts and a plurality of full-length panels, each said panel having horizontally disposed means for resisting outward and downward forces which are placed on said side wall by a load within said container, said means for resisting forces being formed by generally longitudinally extending corrugated ribs to individually and independently provide beam strength for each panel, there being full-length slip joint attachments on upper and lower edges of each of said full-length panels permitting horizontal, longitudinal movement between adjacent full-length panels relative to each other after assembly, said full-length slip joint attachments formed as inter-locking configurations having a cross bar of a "T" shape fitting with an opening of a downwardly opening "C" shape, permitting slip together assembly and said horizontal, longitudinal movement after assembly, allowing each of said full-length panels to react as independent beams in resisting forces of said load within said container, said side wall construction having a pre-stressed condition through the forcible bowing of said top rail from said bottom rail, said forcible bowing maintained by the use of said side posts being longer by a calculated amount than said corner posts, said pre-stressed condition being operable to reduce compressive forces on said top rail.

7. The side wall construction of claim 6 further including said full-length top rail having a full-length slip joint attachment configured as a downwardly opening "C" shape for slidingly attaching an uppermost full-length panel.

8. The side wall construction of claim 6 further including said full-length bottom rail having a full-length slip joint attachment configured as a "T" shape for slidingly attaching a lowermost full-length panel.

9. The side wall construction of claim 6 wherein said corner posts are attached at ends of the attached full length panels, ends of the top rail and ends of the bottom rail providing end support for said attached full-length panels.

10. The side wall construction of claim 6 wherein the uppermost corrugation of each panel is positioned inwardly toward the center of said container to cause inward buckling of said full-length panels providing counter-active additional beam strength to said full-length panels resisting the outward forces of the load within said container.

* * * * *